US006129147A

United States Patent [19]

Dumetz et al.

[11] Patent Number: 6,129,147

[45] Date of Patent: Oct. 10, 2000

[54] FOLDED AND BRAZED TUBE FOR HEAT EXCHANGER AND HEAT EXCHANGER INCLUDING SUCH TUBES

[75] Inventors: Yvon Dumetz, Chatillon; Carlos Martins, Montfort l'Amaury, both of France

[73] Assignee: Valeo Thermique Moteur, la Verriere, France

[21] Appl. No.: 09/218,248

[22] Filed: Dec. 22, 1998

[30] Foreign Application Priority Data

Dec. 23, 1997 [FR] France ..... 97 16390

[51] Int. Cl.[7] ..... F28F 1/02

[52] U.S. Cl. ..... 165/177; 29/890.053

[58] Field of Search ..... 165/177, 183; 29/890.053, 890.054

[56] References Cited

U.S. PATENT DOCUMENTS

| | | | |
|---|---|---|---|
| 5,186,251 | 2/1993 | Joshi | 165/177 |
| 5,579,837 | 12/1996 | Yu et al. | 165/183 |
| 5,692,300 | 12/1997 | Conn et al. | 29/890.053 |
| 5,704,423 | 1/1998 | Letrange | 165/177 |
| 5,875,668 | 3/1999 | Kobayashi et al. | 72/181 |

FOREIGN PATENT DOCUMENTS

| | | | |
|---|---|---|---|
| 302232 | 1/1988 | European Pat. Off. | 165/177 |
| 1203303 | 8/1970 | United Kingdom | 165/177 |
| 2 141 362 | 12/1984 | United Kingdom . | |

OTHER PUBLICATIONS

French Search Report Sep. 18, 1998.

*Primary Examiner*—Allen Flanigan
*Attorney, Agent, or Firm*—Morgan & Finnegan, LLP

[57] ABSTRACT

A folded and brazed tube consists of at least one metal band folded over itself to form two parallel channels separated by a cross-piece. The cross-piece is formed by at least one margin of the band, which is locally folded from the tube surface towards its interior. At least one sheet is pressed against the outside of the cross-piece and has an edge flush with the surface of the tube in order to delimit a volume formed in the folding region of the margin which must be filled in during brazing. Applications include the manufacture of vehicle engine cooling radiators.

20 Claims, 2 Drawing Sheets

FOLDED AND BRAZED TUBE FOR HEAT EXCHANGER AND HEAT EXCHANGER INCLUDING SUCH TUBES

FIELD OF THE INVENTION

The present invention concerns a folded and brazed tube for heat exchangers such as a motor vehicle engine cooling radiator, for example.

The invention is more particularly concerned with a tube of the above kind comprising a metal band folded on itself to form two parallel channels separated by a cross-piece, the cross-piece being formed by at least one margin of the band folded locally from the surface of the tube towards the interior of the tube.

BACKGROUND OF THE INVENTION

A tube of the above type that has a flat section is already known in itself. A tube of the above kind has large, flat or curved faces against which are brazed or welded undulating spacers forming heat exchange fins with a view to constituting a bundle formed of a multiplicity of tubes and spacers.

A depression is formed on the surface of the tube, at the place where the margin is folded inwards, the depression corresponding to the fact that the fold is not a right-angled fold but a circular arc. This depression must be filled in, on the one hand to assure continuity of each of the large faces of the tube in the regions near the cross-piece and, on the other hand, to assure a sealed connection between the tubes and the header plates of the heat exchanger.

The problem is to fill the brazing opening properly during fabrication of the tube.

SUMMARY OF THE INVENTION

The aim of the invention is to overcome this drawback and more particularly to obtain a tube in which the depressions due to folding are smaller and therefore easier to fill during brazing.

To this end the invention consists in a folded and brazed tube for heat exchangers, in particular for motor vehicles, comprising a metal band folded on itself to form two parallel channels separated by a cross-piece, the cross-piece being formed by at least one margin of the band folded locally from the surface of the tube towards the interior of the tube.

According to the invention the tube comprises at least one sheet pressed against the exterior of the cross-piece and having an edge flush with the surface of the tube adjacent the fold area of the margin.

The advantage of a sheet whose edge is flush with the surface of the tube is that the sheet clearly delimits the volume to be filled during brazing, between itself and the rounded exterior of the local fold in the sheet.

More particularly, if two opposite margins of the band are folded face-to-face to form a cross-piece, the sheet is disposed between the two margins and therefore divides in two the generally triangular shaped space between the two circular arcs. It is therefore easier to fill these two half-spaces with brazing metal than the original complete space.

In one particular embodiment of the invention the sheet is formed by a marginal area of the margin folded 180° on itself.

In another embodiment the sheet is formed by the other margin of the band, opposite the aforementioned margin, folded onto the cross-piece.

More particularly, the sheet can have at least one depression in its thickness within which an exterior part of the local fold in the margin is accommodated.

This depression, which can be formed by pressing or knurling, for example, has a two-fold advantage. On the one hand, it further reduces the volume to be filled with brazing metal. On the other hand, it immobilizes the sheet relative to the cross-piece, assuring that the edge of the sheet is flush with the surface of the tube.

In another aspect the invention concerns a heat exchanger including a bundle of tubes and cooling fins in which the tubes are as defined hereinabove.

Particular embodiments of the invention will now be described by way of non-limiting example and with reference to the accompanying diagrammatic drawings.

DESCRIPTION OF PREFERRED EMBODIMENTS OF THE INVENTION

Figure 1:
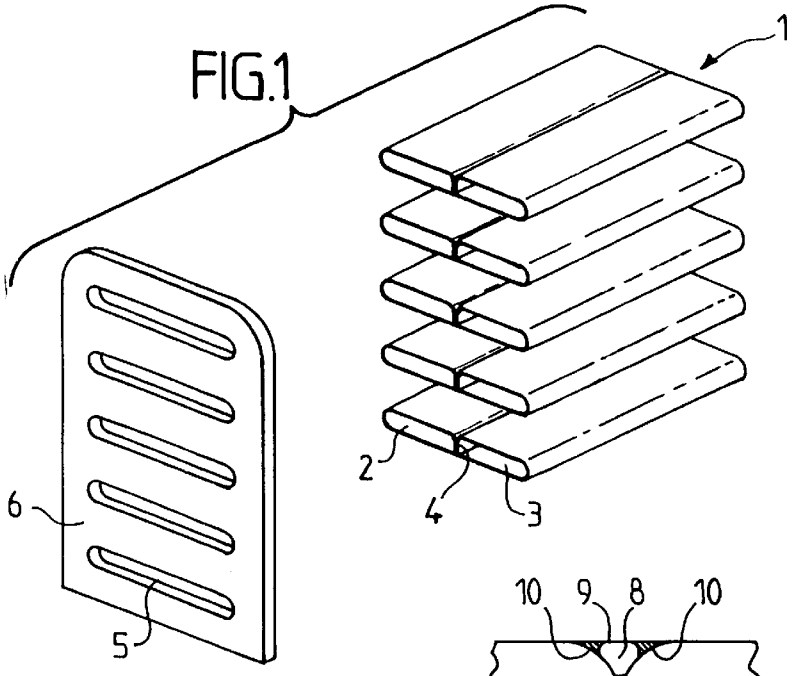
FIG. 1 is an exploded perspective view of a prior art eat exchanger.
Figure 2:
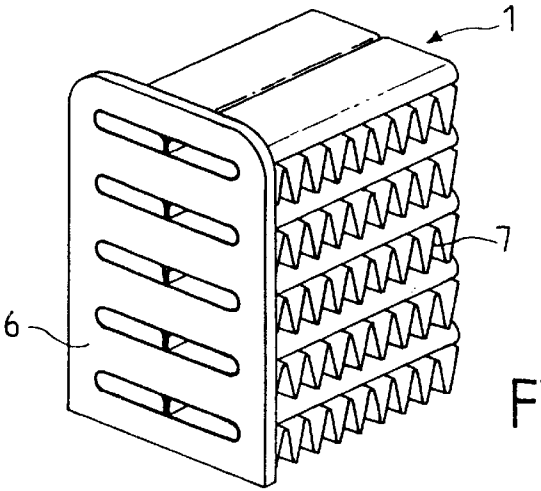
FIG. 2 is a view of the same heat exchanger when assembled.
Figure 3:
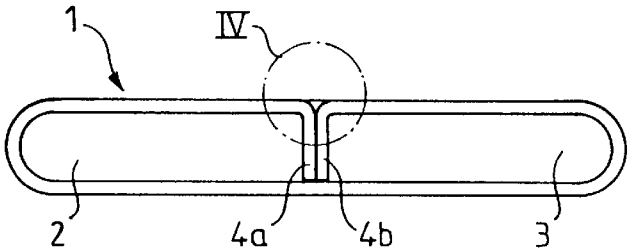
FIG. 3 is an end view of a tube from the heat exchanger shown in FIGS. 1 and 2.

FIG. 1 shows some of the component parts of a prior art heat exchanger, for example a motor vehicle engine cooling radiator.

The radiator is built up from flat tubes 1 made from folded and brazed sheet metal. Each tube 1 comprises a metal band folded to form the envelope of two parallel channels 2 and 3. The channels 2 and 3 are separated by a cross-piece 4 obtained by folding two opposite margins 4*a* and 4*b* of the metal band 90° from the surface of the tube 1 towards its interior. The facing surfaces of the margins 4*a* and 4*b* are brazed together to seal the tube 1. The ends of the tubes 1 are engaged in slots 5 in two header plates 6 (only one of which is shown here), on which the header boxes at the ends of the heat exchanger are mounted. During assembly cooling fins 7 made from sheet metal folded to an undulating shape are inserted between the tubes 1.

Figure 4:
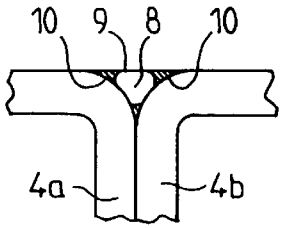
FIG. 4 is a view to a larger scale of the detail IV from FIG. 3.

FIG. 4 shows that the embodiment just described for the tubes 1 leads to the formation of a substantially triangular section volume 8 that must be filled in with brazing metal, at least at the ends of the tubes 1, in order to seal them after they are assembled to a header plates 6.

The volume 8 is in fact delimited by the plane 9 of the outside surface of a tube 1 and by the two quarter-cylinders 10 comprising the outside surface of folds in the sheet metal of the tube 1 forming the two half-cross-pieces 4*a* and 4*b*. The aim of the invention is to divide up the volume 8 so that it is easier to fill during brazing.

Figure 5:
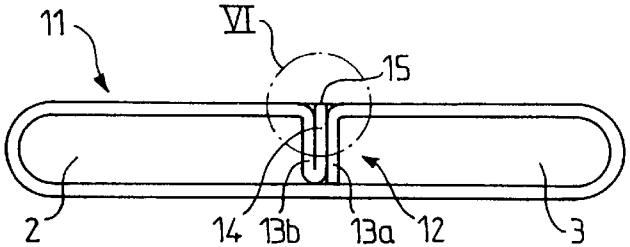
FIG. 5 is a view similar to FIG. 3 of a tube in accordance with the invention.
Figure 6:
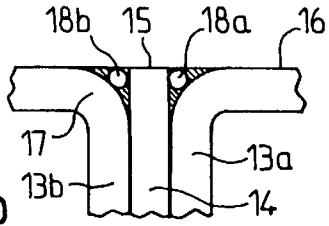
FIG. 6 is a view to a larger scale of the detail VI from FIG. 5.
Figure 8:
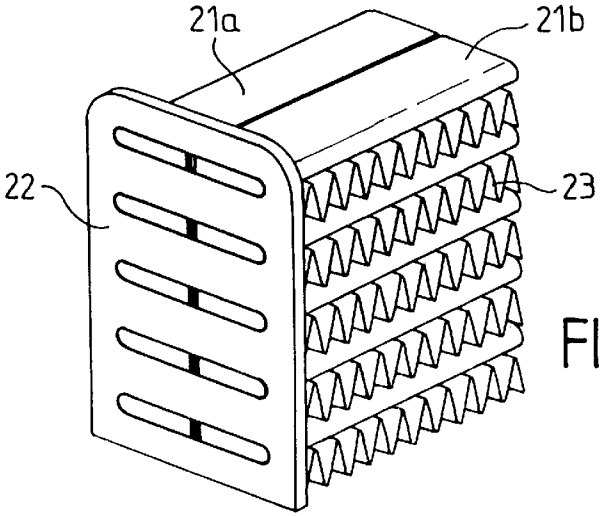
FIG. 8 is a view of the heat exchanger from FIG. 7 after assembly.
Figure 9:
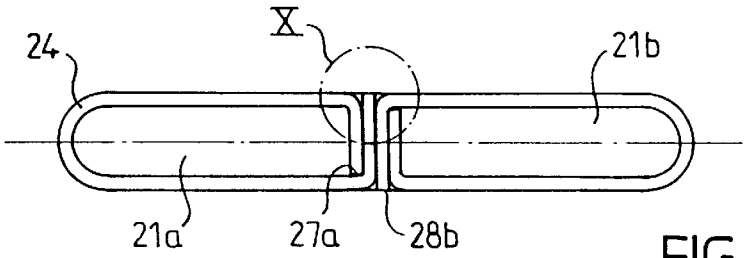
FIG. 9 is an end view of a tube from the heat exchanger shown in FIGS. 7 and 8.

FIGS. 5 and 6 show a tube 11 in accordance with the invention.

This tube is made substantially as previously, by folding a metal band. The two opposite margins of the band are folded from the surface of the tube towards its interior to form a cross-piece 12. As before, the cross-piece is formed firstly by a margin 13*a* of the band folded 90°. The cross-piece 12 also comprises the opposite margin 13*b* of the band, but here its marginal area is folded 180° outwards on itself to form a sheet 14, an edge 15 of which is flush with an outside surface 16 of the tube 11.

The sheet 14 is folded outwards relative to the part of cross-piece 13*b*, i.e. convex side of a fold 17 producing that half-cross-piece. The sheet 14 is therefore disposed between the half-cross-pieces 13*a* and 13*b*.

The edge of the sheet 14 divides the prior art triangular section space into two half-spaces 18*a* and 18*b* with half the volume. They are therefore much easier to fill in when brazing the tube.

Here only the half-cross-piece 13*b* has been folded 180° to form a sheet 14. In an alternative embodiment it would obviously be possible also to fold the marginal area of the half-cross-piece 13*a* to form two sheets equivalent to the sheet 14.

FIGS. 7 through 10 show an embodiment of the invention applied to long tubes.

Here each tube is formed of two separate half-tubes 21*a* and 21*b* made as previously from folded sheet metal and brazed to header plates 22.

Cooling fins 23 in the form of an undulating strip are disposed as previously between the flat tubes each comprising two half-tubes 21*a* and 21*b* joined together.

Each half-tube 21*a*, 21*b* is made from a folded metal band, a middle area 24 of which forms the body of the tube. A first margin of the metal band is folded from the surface of the tube 21*a* towards its interior to form a first cross-piece 25*a* coming into contact with the inside surface of the tube opposite the fold area.

In accordance with the invention, the other margin of the band, opposite the first margin, is folded from the surface of a tube outwards, immediately after the edge 27*a* of the cross-piece 25*a*, to form a sheet 26*a*. The edge 28*a* of an sheet 26*a* is flush with the outside surface of the tube.

The other half-tube 21*b* is made in the same way with the result that its cross-piece 25*b* is inside the half-tube and its sheet 26*b* is on the outside. The half-tubes 21*a* and 21*b* are folded in opposite directions with the result that the edge 28*b* of the sheet 26*b* is on the opposite side of the flat tube to the edge 28*a* of the sheet 26*a*. The assembly is such that, starting from the left in FIGS. 9 and 10, the cross-piece 25*a* and the sheet 26*a* of the half-tube 21*a* and the sheet 26*b* and the cross-piece 25*b* of the half-tube 21*b* are pressed successively against each other.

Figure 10:
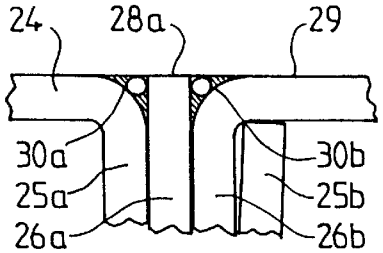
FIG. 10 is a view to a larger scale of the detail X from FIG. 9.
Figure 7:
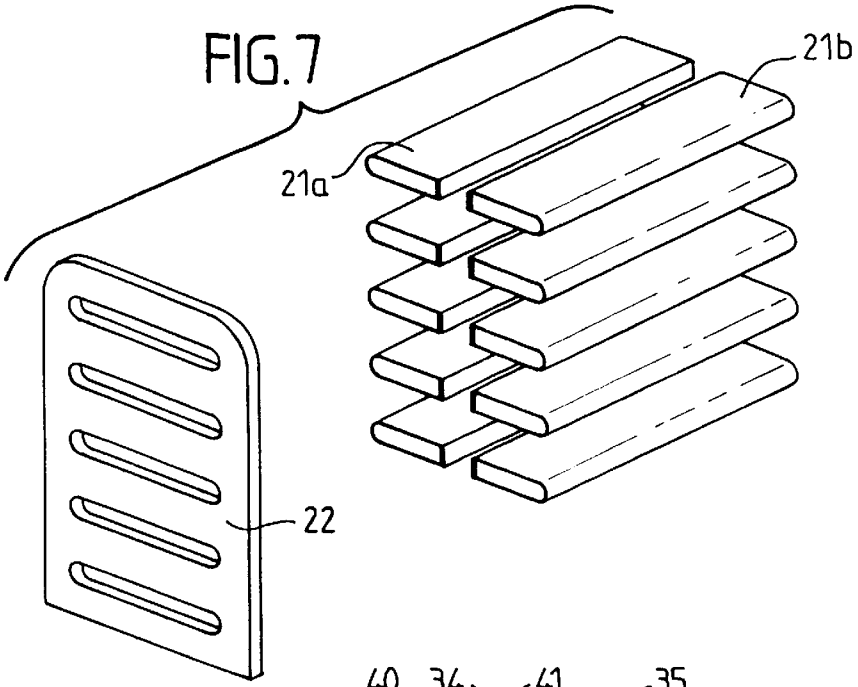
FIG. 7 is an exploded perspective view of a heat exchanger made from tubes constituting a different embodiment of the invention.

There are therefore two opposite volumes of each tube to be filled in during brazing. FIG. 10 shows one of these volumes, whose substantially triangular section is defined by a surface 29 of the tube and by two quarter-cylinders 30*a* and 30*b* formed by the outside surface of the fold of the cross-piece 25*a*, on the one hand, and the sheet 26*b*, on the other hand. Here this volume is divided into two equal parts by the edge of the sheet 26*a*.

Similarly, the edge of the sheet 26*b* divides in two the volume formed on the other side of the tube by the fold of the sheet 26*a* and that of the cross-piece 25*b*.

Figure 11:
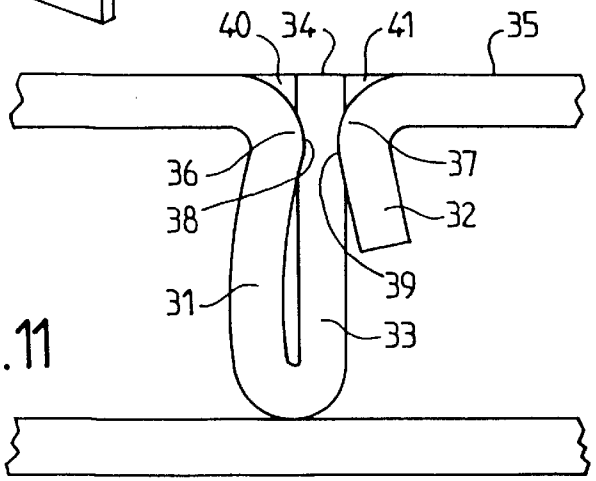
FIG. 11 is a view to a larger scale of a detail of a tube constituting a further embodiment of the invention.

In the FIG. 11 embodiment, which is similar to that of FIGS. 5 and 6, a single margin 31 of the metal band is folded from the surface of the tube towards its interior to form a cross-piece, coming into contact with the opposite face of the tube. The other margin 32 is folded only to enable it to be brazed.

The marginal area of the margin 31 is folded substantially 180° outwardly of the cross-piece to form a sheet 33 whose edge 34 is flush with a surface 35 of the tube.

Here the cross-piece 31 is folded to an angle slightly less than 90° to form a projection 36 facing a projection 37 formed by the fold of the margin 32. The sheet 33 has two depressions 38 and 39 in its thickness, here formed by crushing, for example using a press or by knurling. The depressions 38 and 39 receive the respective projections 36 and 37 so that volumes 40 and 41 to be filled in during brazing are smaller and a flat outside surface of the tube is assured by virtue of rigorous positioning of the edges of the band relative to the edge 34 of the sheet 33.

What is claimed is:

1. A folded and brazed tube for heat exchangers, comprising:

a metal band folded on itself to form two parallel channels separated by a cross-piece, said cross-piece being formed by at least one margin of said band folded locally from a surface of said tube towards an interior of said tube and at least one sheet pressed against an exterior of said cross-piece and having an edge flush with an exterior surface of said tube adjacent the fold area of said margin.

2. The tube according to claim 1, wherein the sheet is formed by a marginal area of the margin folded 180° on itself.

3. The tube according to claim 1, wherein the sheet is formed by the other margin of the band,opposite the locally folded margin, folded onto said cross-piece.

4. The tube according to claim 1, wherein the sheet has at least one depression in its thickness adapted to accommodate an exterior part of the localized fold of said margin.

5. A heat exchanger including cooling fins and a bundle of tubes according to claim 1.

6. A motor vehicle including the heat exchanger of claim 5.

7. A tube for a heat exchanger, comprising:

at least one metal band folded and arranged to form a pair of folded portions defining comers which oppose each other at the location of a cross-piece dividing the tube into channels; and a sheet having one free edge interposed between the opposing comers which subdivides the space therebetween.

8. The tube according to claim 7, wherein said at least one metal band comprises a first metal band and a second metal band, said first and second bands folded to form the two channels.

9. The tube according to claim 7, wherein the sheet is a margin of said at least one metal band folded on itself.

10. The tube according to claim 7, wherein the sheet is a margin of said at least one metal band folded 180° degrees on itself.

11. The tube according to claim 7, further comprising a crosspiece separating the two channels, said crosspiece comprising a folded margin of said at least one metal band, the sheet being pressed against said crosspiece.

12. The tube according to claim 7, wherein the two channels are parallel to each other.

13. A heat exchanger including the tube according to claim 7.

14. A tube for a heat exchanger, comprising:

at least one metal band folded and arranged to form a pair of folded portions defining corners which oppose each other at the location of a cross-piece dividing the tube into channels; and means, interposed between the opposing corners, for subdividing the space between the opposing corners.

15. A method of forming a tube for a heat exchanger comprising:

folding at least one metal band on itself to form two parallel channels separated by a cross-piece, said cross-piece being formed by at least one margin of said band folded locally from a surface of said tube towards an interior of said tube and at least one sheet pressed against an exterior of said cross-piece and having an edge flush with an exterior surface of said tube adjacent the fold area of said margin.

16. The method according to claim 15, wherein said folding of said at least one metal band includes folding a marginal area of the margin 180° on itself to form said sheet.

17. The method according to claim 15, wherein said folding of said at least one metal band includes folding the other margin of the band, opposite the locally folded margin, onto said cross-piece to form said sheet.

18. The method according to claim 15, wherein the sheet has at least one depression in its thickness adapted to accommodate an exterior part of the localized fold of said margin.

19. The method according to claim 15, wherein said at least one metal band comprises a first metal band and a second metal band.

20. A method of assembling a heat exchanger, comprising forming a tube according to claim 15.

* * * * *